US009556566B2

(12) United States Patent
Sanders

(10) Patent No.: US 9,556,566 B2
(45) Date of Patent: Jan. 31, 2017

(54) LEVELING PLATE APPARATUS FOR A ROAD REPAIR SYSTEM

(71) Applicant: Mark E. Sanders, Whitestown, IN (US)

(72) Inventor: Mark E. Sanders, Whitestown, IN (US)

( * ) Notice: Subject to any disclaimer, the term of this patent is extended or adjusted under 35 U.S.C. 154(b) by 0 days.

(21) Appl. No.: 14/741,753

(22) Filed: Jun. 17, 2015

(65) Prior Publication Data

US 2015/0284915 A1 Oct. 8, 2015

Related U.S. Application Data

(63) Continuation-in-part of application No. 14/661,795, filed on Mar. 18, 2015.

(60) Provisional application No. 61/955,284, filed on Mar. 19, 2014, provisional application No. 62/013,388, filed on Jun. 17, 2014.

(51) Int. Cl.

| | |
|---|---|
| ***E01C 11/00*** | (2006.01) |
| ***E01C 5/00*** | (2006.01) |
| ***E01C 23/00*** | (2006.01) |
| ***E01C 5/06*** | (2006.01) |
| ***E01C 11/14*** | (2006.01) |
| ***E01C 23/10*** | (2006.01) |

(52) U.S. Cl.

CPC ..... *E01C 5/005* (2013.01); *E01C 5/06* (2013.01); *E01C 11/005* (2013.01); *E01C 11/14* (2013.01); *E01C 23/00* (2013.01); *E01C 23/10* (2013.01)

(58) Field of Classification Search

CPC ..... E01C 5/005; E01C 5/06; E01C 7/147; E01C 11/005; E01C 11/14; E01C 23/00; E01C 23/10

USPC ..... 404/34–36, 47, 56–73, 75, 78

See application file for complete search history.

(56) References Cited

U.S. PATENT DOCUMENTS

| | | | | | |
|---|---|---|---|---|---|
| 1,089,380 | A * | 3/1914 | McDonald | E01C 9/083 | 404/35 |
| 1,915,032 | A * | 6/1933 | Poulter | E01C 23/10 | 104/11 |
| 4,962,913 | A * | 10/1990 | Stewart | B66C 1/28 | 254/269 |
| 4,972,537 | A * | 11/1990 | Slaw, Sr. | E01D 19/125 | 14/73 |
| 5,586,834 | A * | 12/1996 | Tsuji | E01C 11/14 | 404/60 |
| 5,720,067 | A * | 2/1998 | Grearson | E01D 19/125 | 14/73 |
| 6,558,071 | B1 * | 5/2003 | Sproules | E01C 5/08 | 404/78 |

(Continued)

*Primary Examiner* — Raymond W Addie

(74) *Attorney, Agent, or Firm* — Maginot, Moore & Beck LLP

(57) ABSTRACT

A precast concrete road repair panel is configured to be received in a prepared portion of an existing road under repair. Openings are provided throughout the panel for introducing grout or other similar composition to fix the precast panel in place on the road sub-base. The panel is further provided with a leveling plate system that includes one or more sleeves embedded within corresponding openings in the panel and accessible at the upper surface of the panel. The leveling plate system includes a base plate for positioning on the road sub-base, the base plate including a post telescopingly disposed within the sleeve. A power cylinder engages the sleeve and includes a piston operable to bear against the post to adjust the height and level of the panel.

11 Claims, 5 Drawing Sheets

(56) References Cited

U.S. PATENT DOCUMENTS

| | | | | |
|---|---|---|---|---|
| 6,668,412 | B1 * | 12/2003 | Tadros | E01D 19/125 14/73 |
| 6,688,808 | B2 * | 2/2004 | Lee | E01C 5/06 404/34 |
| 7,134,805 | B2 * | 11/2006 | Yee | F16L 13/113 403/381 |
| 7,448,176 | B2 * | 11/2008 | Drake | E01C 7/147 404/34 |
| 7,607,856 | B2 * | 10/2009 | Patel | E01F 15/003 404/6 |
| 8,591,143 | B1 * | 11/2013 | Knapp | E01C 23/06 254/2 R |
| 8,756,898 | B1 * | 6/2014 | Backhaus | E04B 5/023 404/47 |
| 8,911,173 | B2 * | 12/2014 | Ulislam | E01O 5/005 404/17 |
| 9,255,404 | B2 * | 2/2016 | Willems | E04C 2/049 |
| 2006/0117678 | A1 * | 6/2006 | Neighbours | B66F 3/08 52/125.1 |
| 2014/0369750 | A1 * | 12/2014 | Siqueiros | E01C 5/003 404/82 |
| 2015/0167260 | A1 * | 6/2015 | Siqueiros | E04G 21/142 404/73 |

* cited by examiner

LEVELING PLATE APPARATUS FOR A ROAD REPAIR SYSTEM

REFERENCE TO RELATED APPLICATION

This application is a non-provisional of and claims priority to Provisional Application No. 62/013,388, filed on Jun. 17, 2014, and is a continuation-in-part of co-pending Utility application Ser. No. 14/661,795, filed on Mar. 18, 2015, which is a non-provisional of and claims priority to Provisional Application No. 61/955,284, filed on Mar. 19, 2014. The entire disclosure of each of the provisional and utility applications is incorporated herein by reference.

BACKGROUND

With the spring thaw comes the onslaught of potholes in our roadways, followed by the omnipresent road repair crews. The disruption of travel on the streets and highways is a necessary nuisance to restore the roads to a drivable condition. Patching ruts and potholes in a concrete road surface is generally a temporary fix since the patch typically disintegrates relatively quickly.

For the preferred repair process a section of concrete is removed and new concrete poured. However, this process can be lengthy since the concrete must be completely set before the new road surface is ready to receive traffic. Consequently, the street or highway is subjected to lane restrictions, leading to the traffic congestion and even accidents that commuters have grown to dread. There is an extreme need for a concrete road repair system that is efficient and quick.

SUMMARY

The present disclosure contemplates a pre-fabricated or pre-cast road repair panel that is configured to be received in a prepared portion of an existing road under repair. The underside of the panel may be textured to receive a grout or other settable composition suitable to affix the repair panel to the existing road sub-base or underlayment. Openings are provided throughout the panel for introducing grout or other similar composition to fix the pre-cast panel in place. Dowels, rods or rebar may be incorporated into the junction between adjacent pre-cast panels or between the pre-cast panel and the existing road surface.

In one aspect, the panel is further provided with a leveling plate system that includes one or more sleeves embedded within corresponding openings in the panel and accessible at the upper surface of the panel. The leveling plate system includes a base plate for positioning on the road sub-base, the base plate including a post telescopingly disposed within the sleeve. A power cylinder engages the sleeve and includes a piston operable to bear against the post to adjust the height and level of the panel. The power cylinder engaged to one or more sleeves of the leveling plate system may be selectively actuated as needed to adjust the height and level of the road panel.

DETAILED DESCRIPTION

Figure 1:
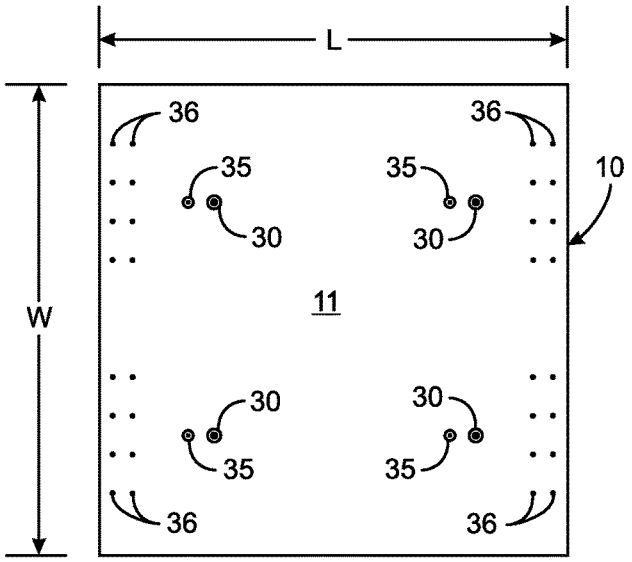
FIG. 1 is top plan view of a pre-cast concrete road repair panel according to one embodiment of the present disclosure.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
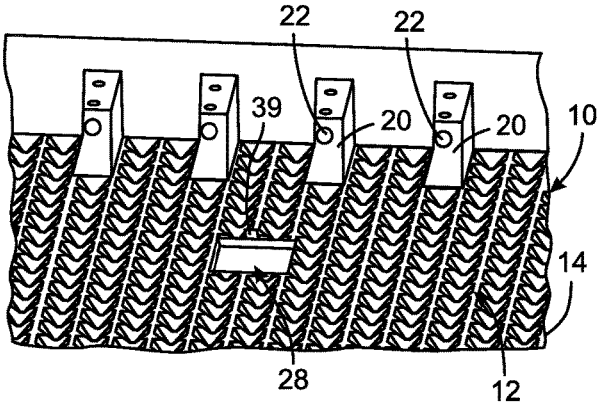
FIG. 2 is an enlarged bottom view of a portion of the pre-cast road repair panel shown in FIG. 1.
Figure 3:
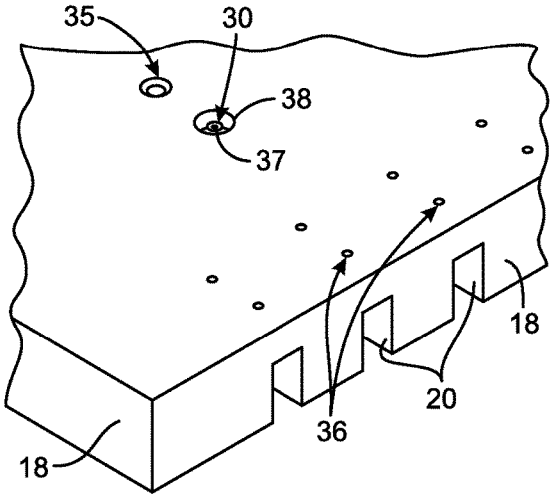
FIG. 3 is an enlarged perspective view of a portion of the pre-cast road repair panel shown in FIG. 2.

Referring to FIGS. 1-3, a pre-cast concrete road repair panel 10 is shown. The panel is pre-fabricated or pre-cast and is preferably provided in a uniform size corresponding the typical lane width of a street or highway. In particular, the concrete panel may be pre-cast in a conventional casting mold with a width W of twelve (12) feet. The length L of the pre-cast panel 10 may vary depending upon the road surface being repaired and the extent of the damage. Thus, in one aspect the pre-cast panel may be provided in lengths from four (4) feet to eighteen (18) feet. The pre-cast panels may be provided in a selection of standard lengths, such as 4, 8, 12, and 18 feet lengths, so that the pre-cast panels may be prefabricated and stored for use when needed. The thickness of the panels corresponds to the thickness of the remaining road surface at the road repair site. For typical road surfaces the minimum thickness permitted by government regulations is six (6) inches, although most road surfaces have thickness of eight (8) to eleven (11) inches.

Figure 4:
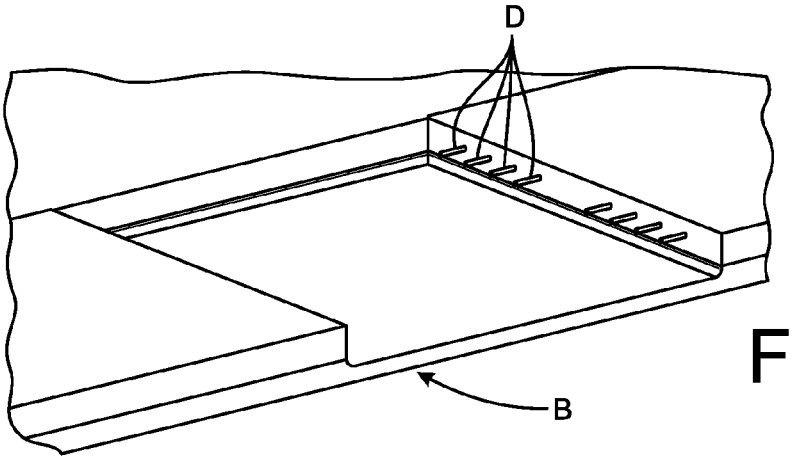
FIG. 4 is a perspective view of an existing road surface being repaired in a first step of the repair according to one aspect of the present disclosure.

As shown in FIG. 2, the underside or bottom surface 12 of the pre-cast concrete panel 10 is provided with surface texturing 14 to provide increased surface area and gripping capability for a sealant, epoxy, adhesive, grout or other composition adapted to affix or adhere the pre-cast panel 10 to the existing road surface, road underlayment or sub-base B, as shown in FIG. 4. In one specific embodiment the texturing 14 may constitute a repeating array of grooves or ridges that are configured to provide a plurality of gaps between the bottom surface 12 of the panel and the road surface or sub base B. As shown in FIG. 3, the side walls 18 of the pre-cast concrete repair panel 10 may be provided with a series of voids or cavities 20 extending a predetermined distance into the panel. In one embodiment, the cavities may extend three to four (3-4) inches into the panel. Additional bores 22 may be provided at the base of each cavity 20 as shown in FIG. 2 to receive an elongated anchor element, such as a dowel, rod or rebar. The cavities are configured to receive a composition adapted to affix the pre-cast panel 10 to the road underlayment or sub-base as well affix to a dowel or rebar integrated into the existing road surface.

The pre-cast panel 10 further includes a leveling feature that allows the panel to be adjusted at the repair site so that it is flush with the existing road surface. Thus in one aspect, a plurality of leveling plates 28 are provided that project adjustably from the underside of the panel, as shown in FIG. 2. In one embodiment, four leveling plates are provided at uniform locations of the panel, such as in the center of corresponding quadrants of the panel. An adjustment mechanism 30 is accessible at the top surface 11 as shown in FIGS. 1 and 3, which may constitute a lead screw arrangement to raise and lower the leveling plate relative to the underside 12 of the panel. In some applications it is preferable that the adjustment mechanism include an air, hydraulic or air over hydraulic cylinder arrangement, in which case the mechanism 30 includes a fitting 37 that is accessible through an opening 37. The fitting is connected to a cylinder 39 (FIG. 2) to which the leveling plate 28 is attached. Air or hydraulic pressure applied through the fitting 37 extends the cylinder 39 and thus the leveling plate 28. The adjustment mechanisms are configured to permit adjustments of less than one (1) inch. It is contemplated that the adjustment mechanism 30 is capable of maintaining the position of the pre-cast panel 10 above the sub base B for a time sufficient to allow the affixing composition to set. It is contemplated that the adjustment mechanism may also be capable of maintaining its adjusted configuration as a load bearing component of the pre-cast road panel.

The panel 10 is further provided with a plurality of openings 35 that communicate with the bottom surface 12 of the panel, and particularly with the texturing 14. The openings 35 are sized for injection of a composition adapted to affix the pre-cast panel 10 to the road underlayment, such as a grout composition. Similar openings 36 may be provided at each of the cavities 20 to allow grout to be injected into the cavities when the panel is installed. The openings 35, 36 are in communication with the gaps formed by the surface texturing 14 so that any space between the concrete panel 10 and the road surface or sub base B can be filled with the composition.

Figure 5:
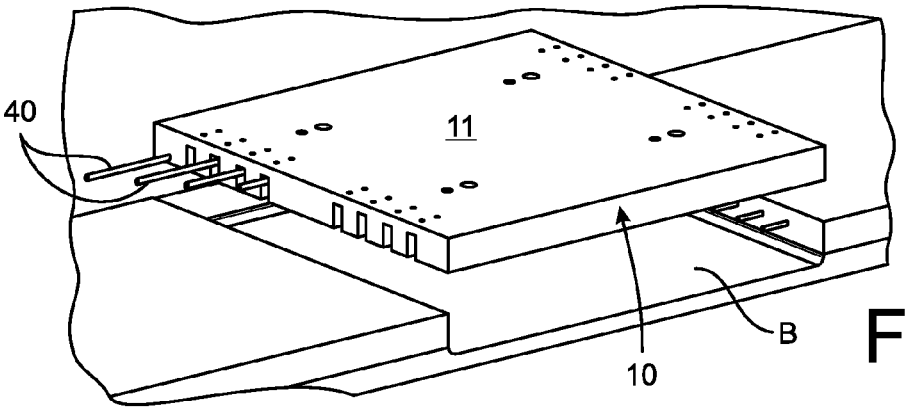
FIG. 5 is a perspective view of the road repair in a second step of the repair process.
Figure 6:
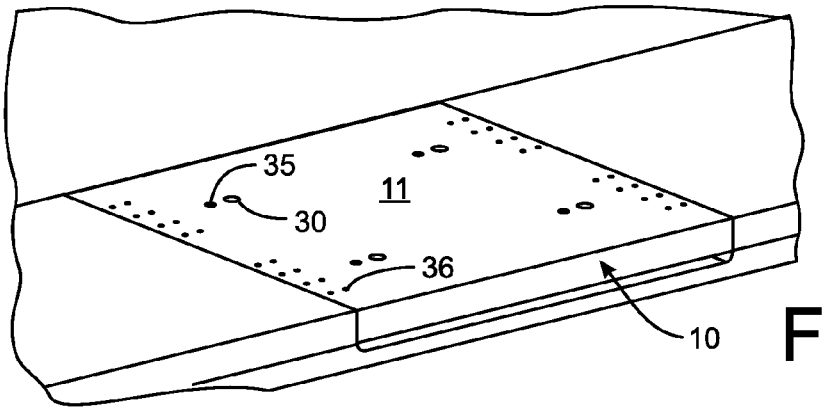
FIG. 6 is a perspective view of the road repair in a third step of the repair process.

FIGS. 4-6 illustrate steps in a road repair using the pre-cast concrete road repair panel 10 disclosed herein. The road surface is prepared by removing the damaged portion of the existing road and carving out the road according to the dimensions of the repair panel 10. Anchoring elements, such as dowels D, may be implanted into the existing concrete of the road, as shown in FIG. 4. With the road sub-base B exposed, the panel 10 is installed. In one aspect, the grout holes 35 may be threaded to receive a lifting element, such as a bolt or ring, which can be lifted and lowered by a cable. As shown in FIG. 5, additional anchoring elements, such as dowels 40, may be incorporated into the panel 10, particularly where a series of such panels 10 are utilized to repair a large gap in the road surface. The panel is lowered onto the sub-base B with the dowels D seated within the cavities 20. Once the panel 10 is seated, the leveling plate 28 may be adjusted using the adjustment mechanism 30 to ensure that the top surface 11 of the panel is flush with the existing road. Grout or other similar sealant composition may then be injected through each of the openings 30, 35, 36 to complete the process. The grout may be a rapid setting composition so that the repaired road surface is ready to receive traffic within minutes of installation.

Figure 7:
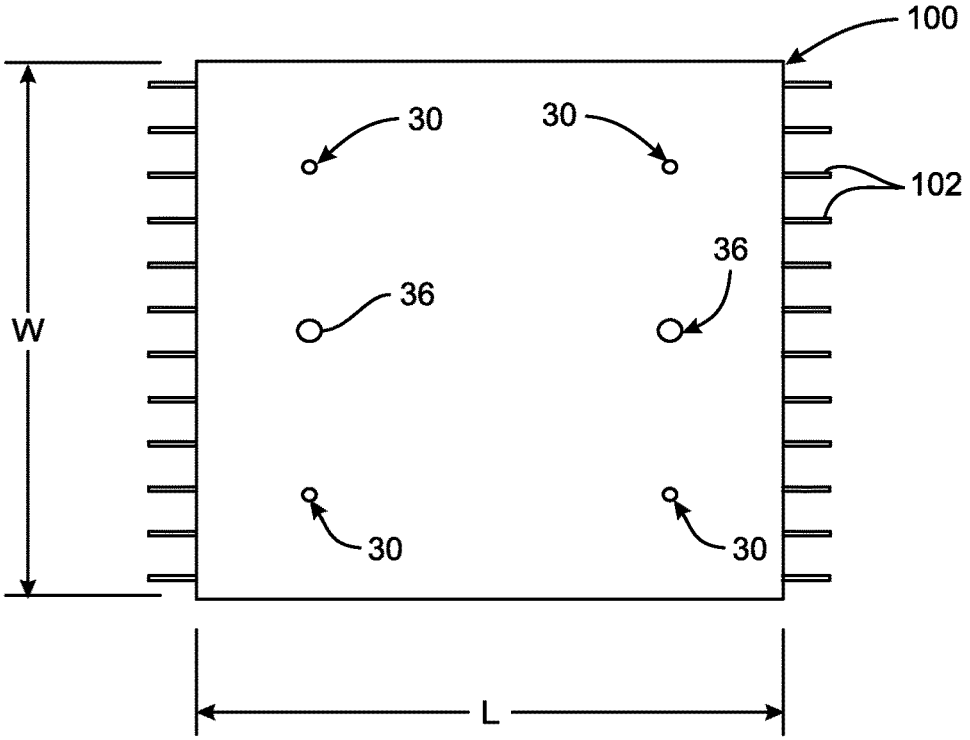
FIG. 7 is a top view of a pre-cast concrete roar repair panel according to a further embodiment of the present disclosure.
Figure 8:
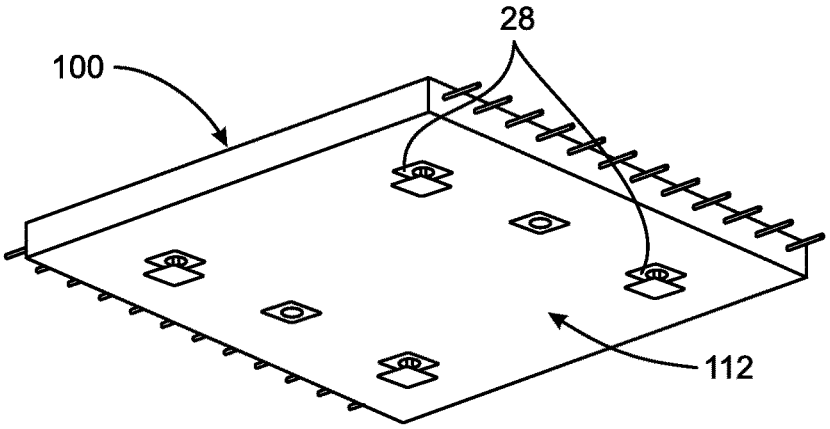
FIG. 8 is a perspective view of the bottom of the road repair panel shown in FIG. 7.
Figure 9:
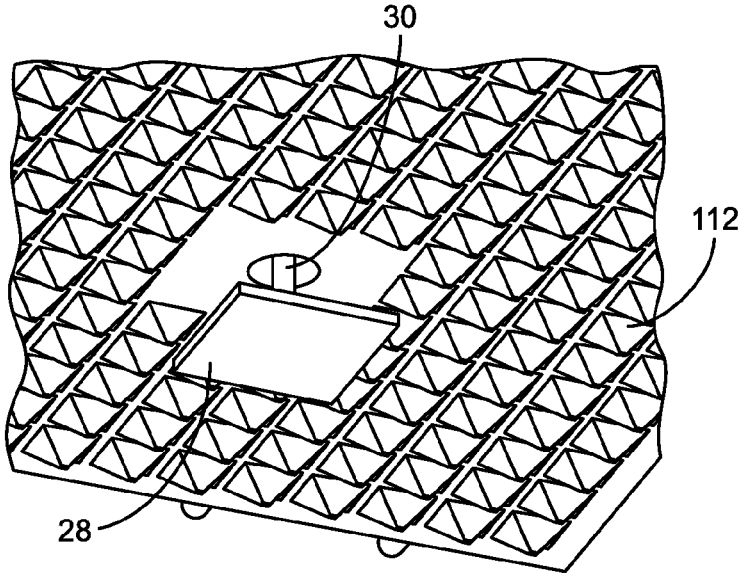
FIG. 9 is an enlarged perspective view of a portion of the bottom of the road repair panel shown in FIG. 7.
Figure 10:
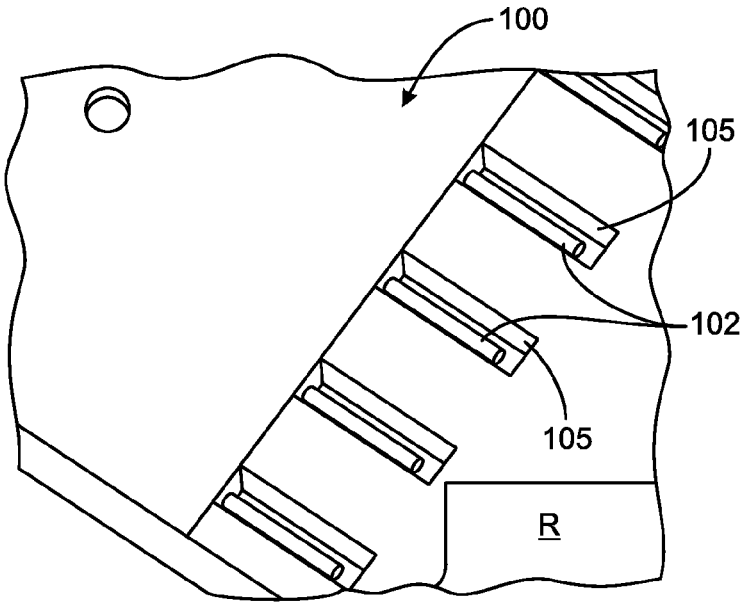
FIG. 10 is an enlarged perspective view of the road repair panel shown in FIG. 7 introduced into an existing road surface.
Figure 11:
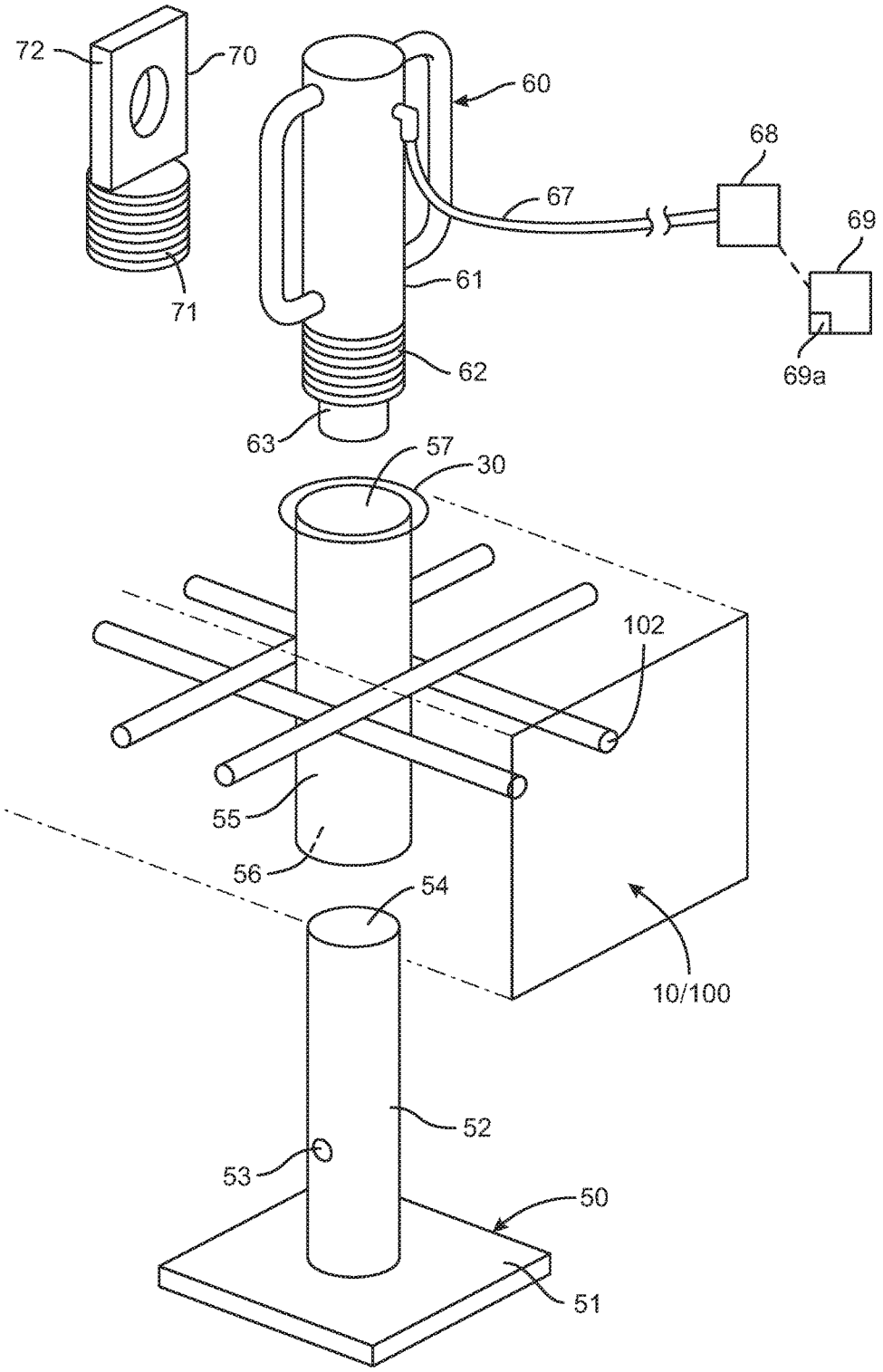
FIG. 11 is an exploded perspective view of a road repair leveling system according to a further aspect of the present disclosure.

A modified pre-cast concrete road repair panel 100 is shown in FIGS. 7-10. The panel 100, like the panel 10, has a width W that can correspond to the road lane width. Thus, the width W is typically twelve (12) feet. The panel 100 can have a length L that may be varied depending upon the application. For most applications, the length L may be four to eighteen (4-18) feet. The panel 100 incorporates elongated anchoring elements, such as dowels, rods or rebar 102, extending at least from two opposite sides of the panel, as shown in FIG. 7. The panel 100 may incorporate the same texturing on the underside 112 as in the panel 10, as well as the leveling plates 28, leveling mechanism 30 and grout holes 36. In this embodiment, the existing road surface R is prepared by forming pockets 105 to receive the dowels 102, as shown in FIG. 10. The pockets 105 are then filled with an epoxy or other settable composition adapted to affix or seal the dowel 102 to the existing road concrete.

In one aspect, the present disclosure contemplates a pre-cast concrete road repair panel that is configured to be received in a prepared portion of an existing road under repair. The underside of the panel is textured to receive a grout or other settable composition suitable to affix the repair panel to the existing road sub-base or underlayment. The panel is provided with leveling plates that can be adjusted to ensure that the repair panel is flush with the existing road surface. Openings are provided throughout the panel for introducing grout or other similar composition to fix the pre-cast panel in place.

In a further aspect, a leveling plate system 50 is provided that simplifies the process for both leveling a newly installed pre-cast repair panel, such as panel 10 or 100, and for removing a panel in need of replacement. The plate system 50 includes a flat base plate 51 that is positioned on the road bed to support the repair panel 10/100 as grout is pumped under the panel to fill voids between the precast concrete panel and the road bed, as described above. A post 52 projects upward from the plate 51. The post 52 is telescopically received within a sleeve 55 that is embedded within the precast concrete panel 10/100, and in particular within and accessible through an adjustment hardware opening 30. The sleeve 55 has a hollow interior 56 configured to receive the post 52 of the leveling plate 50. A retention mechanism, such as a ball catch 53, may be provided to temporarily hold the post within the sleeve as the precast panel is transported and installed. The sleeve may thus be provided with a recess defined in the hollow interior 56 of the sleeve to receive the ball catch. The ball catch 53 may be spring biased within the post so that it can be dislodged from the sleeve 55 when it is desired to move the road panel 10/100 relative to the base plate 50.

It can be appreciated that the sleeve 55 has a length less than the thickness of the precast panel so that the upper end of the sleeve is beneath the top surface of the panel. The sleeve may be positioned within the precast panel so that the upper end of the sleeve is recessed below the panel surface a sufficient distance so that the sleeve is not exposed after normal wear of the road surface.

The upper end of the hollow interior 56 of the sleeve 55 includes internal threads 57 that are adapted to mate with a power tool. In particular, a power cylinder 60 is provided that is used to lift the precast panel relative to the leveling plate 51. The power cylinder 60 includes a cylinder body 61 having a threaded end 62 configured to mate with the internal threads 57 of the sleeve, although other engagement mechanisms are contemplated for releasably engaging the power cylinder body 61 to the sleeve 55. The power cylinder 60 includes a piston 63 that is advanced or retracted within the body 61. In one embodiment the power cylinder 60 is a hydraulic or pneumatic power cylinder that is operable to extend the piston 63 under controlled pressure via a connection, such as a pressure hose 67, connected to a power source, such as a pressure source 68. Other power cylinder approaches are contemplated that are capable of controlled advancement of the power piston 63 and are capable of holding the piston in its extended position during a grout and curing process. The power source 68 and connection 67 would be modified accordingly depending on the nature of the power piston. For instance, the power cylinder 60 may a controllable solenoid, in which case the power source is a battery or other electrical source and the connection is an electrical cable.

The power piston 63 is configured to contact the top surface 54 of the post 52 of the leveling plate 51. When the power cylinder 60 is engaged to the sleeve 55 the power piston 63 can be advanced until it contacts the post 52. Since the sleeve 55 is engaged to the body 61 of the power cylinder, continued movement of the power piston pushes the precast panel 10/100 upward away from the leveling plate 51. The power cylinder 60 is thus operated to lift the precast concrete panel to an appropriate height and then to hold the panel at that height. A given precast panel may include a single such leveling plate system 50 or may include multiple such systems, such as at the four adjustment hardware openings 30 of the panel 10 shown in FIG. 1. Each leveling plate system 50 is adjusted by its own power cylinder 60. The multiple power cylinders may be individually controlled to lift and level the precast concrete panel, or the cylinders may be controlled by a common controller that relies on height and level sensors to selectively control each of the power cylinders. In one aspect, a controller 69 may control the pressure sources 68 for each power cylinder 60. The controller 69 may incorporate at least two level sensors 69*a* that determine whether the precast panel is level in orthogonal directions and then activate appropriate ones of the power cylinders as needed. The level sensors 69*a* may be of known design that are operable to generate a signal indicative of whether or not the road panel is level or indicative of an angle relative to the horizontal or vertical of the panel for comparison to a level angle. The controller 69 may thus incorporate a computer or microprocessor operable to implement software commands to receive the signals from all of the level sensors and to determine which power cylinders need to be actuated to bring the road panel into level position. It is of course understood that the controller 69 need not be a "smart" controller but instead may be a controller operable by a user to activate the power cylinders based on the user's visual reading of the level sensors 69*a*. In this "manual" operation mode, the level sensors may be simple mechanical or bubble levels. It is further contemplated that the level sensors may be or include sensors capable of evaluating the position of one panel relative to an adjacent road panel at the joint between the panels to ensure that the panels are even across the joint.

Once the precast panel 10/100 has been lifted to an appropriate height and oriented level with the road bed, the grout can be introduced through the openings 35, as described above. The power cylinders hold the panel until the grout has been installed and cured. The power cylinder is removed and the threaded end 57 of the sleeve 55 is closed with a threaded cap. The opening 30 in the precast panel may be appropriate sealed. It is appreciated that the leveling plate system 50 thus remains within the repaired road.

The sleeve 55 also provides a mechanism for removing a precast panel in need of replacement. In this aspect, the opening 30 is re-opened and the cap removed from the sleeve 55, exposing the internal threads 57. A lifting element in the form of a lifting eye 70 may be engaged to the sleeve 55 by threading the threaded end 71 into the threaded end 57 of the sleeve. A lifting body 72 may be engaged to a lifting cable that is used to pull the precast panel up from the road bed. The same sleeve 55 thus provides both a means to simplify the leveling process for precast panels and means to remove damaged panels in need of replacement.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

For instance, in the present disclosure the precast road panel is a concrete panel. However, other road surfaces are contemplated that are capable of being precast into panels configured to be installed on the road bed. Moreover, reference to a road or to road repair is intended to encompass other surfaces, such as parking lots, sidewalks and the like.

What is claimed is:

1. A leveling plate system for a road repair panel including a pre-fabricated road panel with an upper surface, an opposite bottom surface, a number of openings extending from said upper surface to said bottom surface for introduction of a settable composition between the bottom surface and the road bed, the settable composition suitable to affix the repair panel to the existing road surface, and a second number of openings for receiving components of the leveling plate system, the leveling plate system comprising:

at least one base plate configured to be seated on the road bed beneath the pre-fabricated road panel, the base plate including a post projecting upward therefrom for passage into a corresponding one of said second number of openings; and a sleeve embedded within said pre-fabricated road panel in said corresponding one of said second number of openings, said sleeve configured to be telescopically disposed around said post, said sleeve including an engagement end accessible from above the pre-fabricated road panel through said corresponding one of said second number of openings.

2. The leveling plate system of claim 1, further comprising a retention mechanism between said sleeve and said post to temporarily hold said post in engagement with said sleeve.

3. The leveling plate system of claim 1, further comprising a lifting element configured for removable engagement with said engagement end of said sleeve and for engagement with a lifting device to lift the pre-fabricated road panel.

4. The leveling plate system of claim 1, further comprising a power cylinder including:

a cylinder body configured to removably engage said sleeve at said engagement end when said sleeve is embedded within said pre-fabricated road panel; and a piston telescopically disposed within said cylinder body, said piston configured to be extended from said cylinder body to bear against said post of said base plate to thereby adjust the height of the road panel relative to said base plate and to support the road panel on said base plate as the settable composition is introduced between the road panel and the road bed.

5. The leveling plate system of claim 4, wherein the power cylinder is a pneumatic, hydraulic or air over hydraulic cylinder.

6. The leveling plate system of claim 4, wherein the engagement end of said sleeve includes internal thread and said cylinder body of said power cylinder includes external threads for threaded engagement with said internal threads.

7. The leveling plate system of claim 4, in which the pre-fabricated road panel includes at least three second openings and the leveling plate system includes a base plate, a sleeve and a power cylinder corresponding to each of said at least three second openings, said leveling plate system further comprising:

a power source for actuating the piston of each power cylinder; and a controller operably connected to the power source for selectively actuating the piston of each power cylinder.

8. The leveling plate system of claim 7, wherein the controller includes at least one level sensor for sensing whether the road panel is level and is configured to selectively actuate the piston of each power cylinder in response to the level sensor.

9. The leveling plate system of claim 1, wherein the pre-fabricated road panel is a precast concrete panel with the sleeve embedded therein.

10. A method for repairing a road surface comprising:

removing a predetermined width and length of road material to expose the sub-base;

lowering a pre-fabricated road panel onto the exposed sub-base, the panel including;

a bottom surface in contact with the sub-base;

a plurality of openings therethrough in communication with the bottom surface;

at least one leveling plate system including a sleeve embedded within a corresponding one of the plurality of openings and engageable at the upper surface of the panel through the corresponding opening, and a base plate with a post telescopingly disposed within the sleeve;

engaging a power cylinder to each sleeve through the corresponding opening, the power cylinder including a piston operable to contact and push against the post of the corresponding base plate;

selectively actuating the power cylinder engaged to each sleeve to adjust the height and/or level the road panel; and then introducing a settable composition through said at least some of the plurality of openings and into the gap between bottom surface of the pre-fabricated panel and the existing sub-base, the settable composition configured to set and to adhere the pre-fabricated panel to the sub-base.

11. The method of claim 10, wherein the step of lowering the pre-fabricated road panel onto the exposed sub-base includes engaging a lifting mechanism to the sleeve at the upper surface of the panel.

* * * * *